US011646528B2

(12) United States Patent
Li et al.

(10) Patent No.: US 11,646,528 B2
(45) Date of Patent: May 9, 2023

(54) INTERFACE CONNECTOR

(71) Applicant: Dongguan Luxshare Technologies Co., Ltd, Dongguan (CN)

(72) Inventors: TieSheng Li, Dongguan (CN); RongZhe Guo, Dongguan (CN); HongJi Chen, Dongguan (CN); Bin Huang, Dongguan (CN); XiaoKai Wang, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 44 days.

(21) Appl. No.: 17/526,426

(22) Filed: Nov. 15, 2021

(65) Prior Publication Data

US 2022/0285879 A1 Sep. 8, 2022

(30) Foreign Application Priority Data

Mar. 2, 2021 (CN) ..... 202120447680.7

(51) Int. Cl.
*H01R 13/533* (2006.01)
*H01R 12/75* (2011.01)

(52) U.S. Cl.
CPC ..... *H01R 13/533* (2013.01); *H01R 12/75* (2013.01)

(58) Field of Classification Search
CPC ..... H01R 13/533; H01R 13/53; H01R 13/46; H01R 13/516; H01R 12/75; H01R 4/723; H01R 4/716
See application file for complete search history.

(56) References Cited

U.S. PATENT DOCUMENTS 6,980,437 B2 * 12/2005 Bright ..... H05K 7/20418 361/704
7,539,018 B2 * 5/2009 Murr ..... H05K 7/20418 439/372
8,371,861 B1 * 2/2013 Cina ..... H01R 13/6461 439/62
8,444,437 B2 * 5/2013 Szczesny ..... H01R 13/6587 439/607.17

(Continued)

FOREIGN PATENT DOCUMENTS

CN 104977664 B 5/2017

*Primary Examiner* — Harshad C Patel
(74) *Attorney, Agent, or Firm* — Birch, Stewart, Kolasch & Birch, LLP

(57) ABSTRACT

An interface connector disposed at a circuit board, comprising a housing, a first heat dissipating member, and a second heat dissipating member. A first accommodating space is disposed in the housing. The first accommodating space accommodates a first mating connector. One side of the housing is disposed at the circuit board. The first heat dissipating member is disposed at the outside of the housing. The first heat dissipating member passes through the housing and extends into the first accommodating space to be connected with the first mating connector. The second heat dissipating member is disposed at the circuit board. The second heat dissipating member passes through the circuit board and the housing and extends into the housing. The heat from the first mating connector is dissipated through the components of the first heat dissipating member. Thus the heat dissipation issue of mating connector having high power chips can be solved.

10 Claims, 7 Drawing Sheets

(56) References Cited

U.S. PATENT DOCUMENTS

| | | | | |
|---|---|---|---|---|
| 8,556,658 | B2 * | 10/2013 | Szczesny | G02B 6/4278 439/607.2 |
| 8,599,559 | B1 * | 12/2013 | Morrison | H05K 9/0058 361/702 |
| 8,670,236 | B2 * | 3/2014 | Szczesny | H05K 9/0009 174/358 |
| 9,787,034 | B2 * | 10/2017 | Yang | G02B 6/0008 |
| 10,039,208 | B2 * | 7/2018 | Neer | H05K 7/20145 |
| 10,073,231 | B1 * | 9/2018 | Yang | G02B 6/4269 |
| 10,477,729 | B2 * | 11/2019 | Han | F28F 3/06 |
| 10,886,661 | B2 * | 1/2021 | Liu | H01R 13/6271 |
| 10,939,594 | B2 * | 3/2021 | Long | H05K 9/0009 |
| 11,303,059 | B2 * | 4/2022 | Duan | H01R 13/46 |
| 11,404,829 | B2 * | 8/2022 | Kumar | H01R 13/533 |
| 2003/0161108 | A1 * | 8/2003 | Bright | H05K 9/0058 361/707 |

* cited by examiner

INTERFACE CONNECTOR

CROSS-REFERENCE TO RELATED APPLICATION

This application claims the priority benefit of Chinese Patent Application Serial Number 202120447680.7 filed on Mar. 2, 2021, the full disclosure of which is incorporated herein by reference.

BACKGROUND

Technical Field

The present disclosure relates to the technical field of heat dissipation for interface connectors, particularly to an interface connector capable of dissipating heat for a stack-type signal module.

Related Art

Conventional interface connectors are used for insertion of mating connectors such as optical modules, controlling the laser diode to emit optical signals corresponding to electric signals to convert electric signals into optical signals through a chip based on electric signals. During operation, chips and laser diodes in the mating connector would generate heat. When the temperature of optical modules rises to certain level, the operation of mating connectors would be affected without performing heat dissipation. Considering the signal transmission rate is increasing for conventional interface connectors, to allow optical signals to be transmitted over a long distance in an optical cable, the operating power of chips of mating connectors is increasing accordingly. Thus, heat dissipation for interface connectors is a critical issue.

SUMMARY

The embodiments of the present disclosure provide an interface connector tended to solve the problem of heat dissipation for conventional interface connectors used for stack-type mating connectors.

The present disclosure provides an interface connector disposed at a circuit board, comprising a housing, a first heat dissipating member, a second heat dissipating member, and a second assembling member. A first accommodating space is disposed in the housing. The first accommodating space accommodates a first mating connector. One side of the housing is disposed at the circuit board. The first heat dissipating member is disposed at the outside of the housing. The first heat dissipating member passes through the housing and extends into the first accommodating space to be connected with the first mating connector. The second heat dissipating member is disposed at the circuit board. The second heat dissipating member passes through the circuit board and the housing and extends into the housing. The second assembling member abuts against the second heat dissipating member so that the second heat dissipating member can be positioned on the circuit board.

The first heat dissipating member comprises a first heat dissipating member body and a first extending part; the first heat dissipating member body is disposed on an outer surface of the housing; the first extending part extends from the first heat dissipating member body into the first accommodating space through the housing; the first extending part abuts against the first mating connector inserted in the first accommodating space.

The interface connector comprises a first assembling member abutting against the first heat dissipating member, allowing the first heat dissipating member body to abut against a first outer surface of the housing.

The first assembling member comprises a first abutting part and a first engaging part connected with the first abutting part. The first abutting part abuts against the first heat dissipating member body. The first engaging part is engaged with a second outer surface of the housing. The second outer surface is adjacent to the first outer surface.

The first heat dissipating member body comprises a fin-type first heat dissipating component and a first assembling groove disposed in the first heat dissipating component. The first abutting part is disposed in the first assembling groove.

The second heat dissipating member comprises a second heat dissipating member body and a second extending part. The second extending part extends from the second heat dissipating member body into the housing through the circuit board and the housing.

The second assembling member comprises a second abutting part and a second engaging part connected with the second abutting part. The second abutting part abuts against the second heat dissipating member body. The second engaging part passes through a third opening of the circuit board and engages with an edge of the second opening of the housing.

The second heat dissipating member body comprises a fin-type second heat dissipating component and a second assembling groove disposed in the second heat dissipating component. The second abutting part is disposed in the second assembling groove.

The housing comprises a partitioning part partitioning an inner space of the housing to form a first accommodating space and a second accommodating space. The second accommodating space accommodates a second mating connector. The second heat dissipating member extends into the second accommodating space and is connected with the second mating connector.

The interface connector comprises a third heat dissipating member. The third heat dissipating member is disposed at the partitioning part and extends into the second accommodating space to abut against the second mating connector.

In the embodiments of the present disclosure, a first heat dissipating member is disposed at a position at the outside of the housing corresponding to the first accommodating space and passes through the housing to be connected with the first mating connector. The heat emitted by the first mating connector can be transferred to the first heat dissipating member by thermal conduction, and then dissipated into the air through the first heat dissipating member. Through the first heat dissipating member and the second heat dissipating member on the outside of the housing, the heat emitted by the first mating connector can be effectively dissipated to solve the heat dissipation issue of mating connectors equipped with high power chips.

In the embodiments of the present disclosure, the first heat dissipating member is disposed at the outside of the housing and is connected to the first mating connector, and the second heat dissipating member is disposed inside the housing and is connected to the second mating connector. The second heat dissipating member is connected to the first heat dissipating member. The heat from the first mating connector is transferred to the first heat dissipating member by heat conduction and then is dissipated to the air through the first heat dissipating member. The heat from the second mating connector stacked with the first mating connector is transferred to the second heat dissipating member by heat conduction, then is transferred from the second heat dissipating member to the first heat dissipating member by heat conduction, and finally escapes to the air through the first heat dissipating member. By disposing the first heat dissipating member and the second heat dissipating member at the outside and the inside of the housing, and by connecting the first heat dissipating member with the second heat dissipating member, the heat emitted by the first mating connector and the second mating connector can be effectively dissipated through the connected first heat dissipating member and the second heat dissipating member. The heat dissipation issue of optical modules equipped with high power chips can be well handled.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
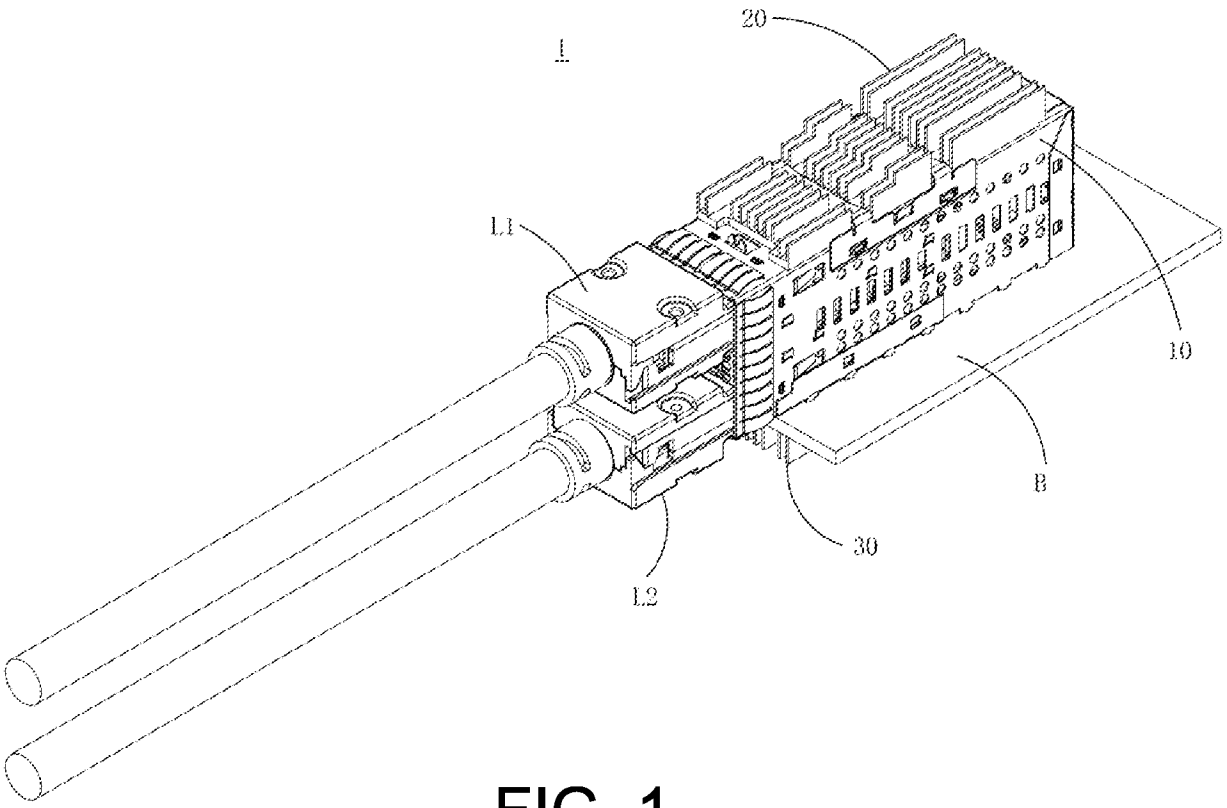
FIG. 1 is a perspective view of connection between an interface connector with a mating connector of an embodiment of the present disclosure.
Figure 2:
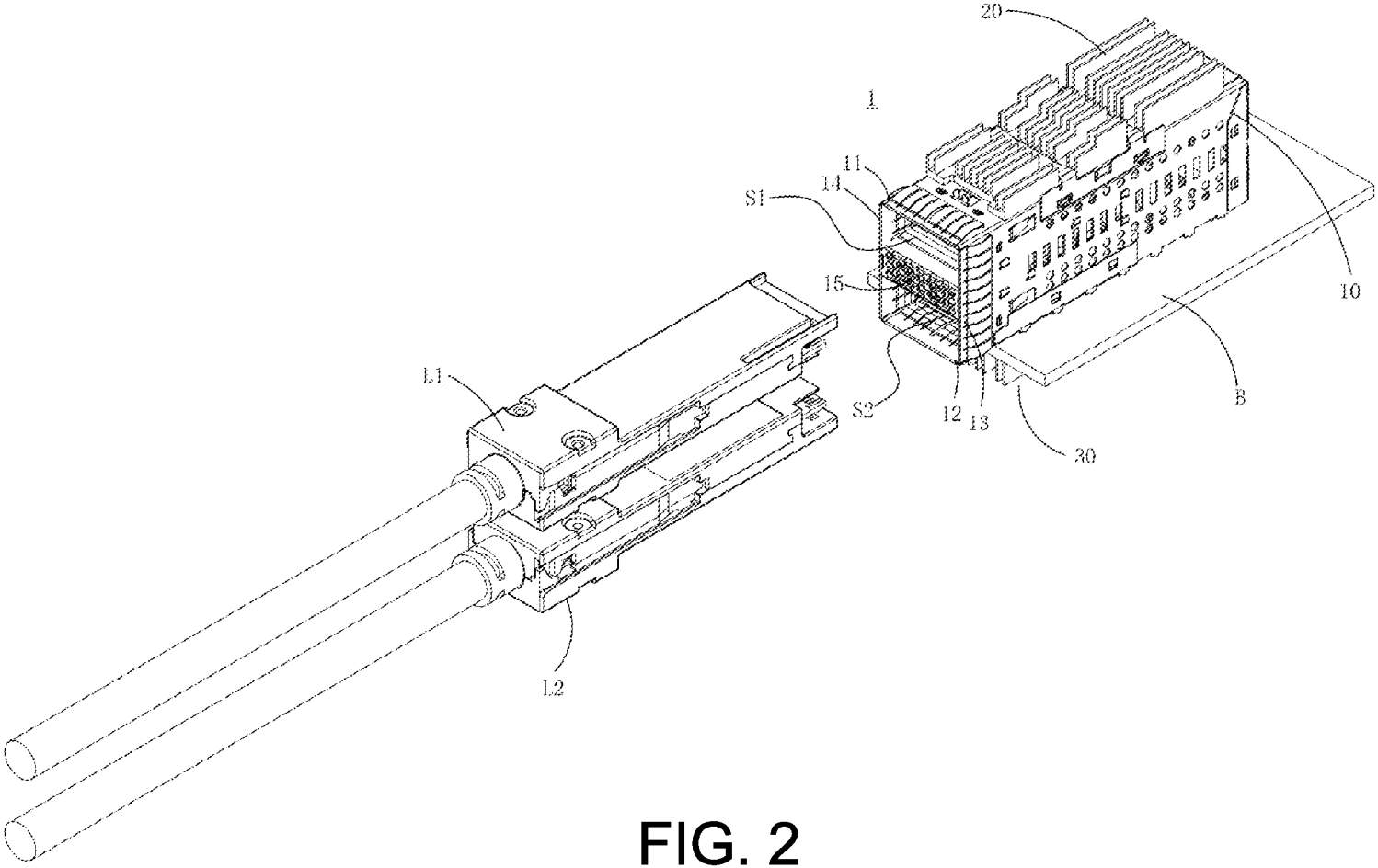
FIG. 2 is a perspective view of the interface connector and the mating connector of FIG. 1 of the present disclosure.
Figure 3:
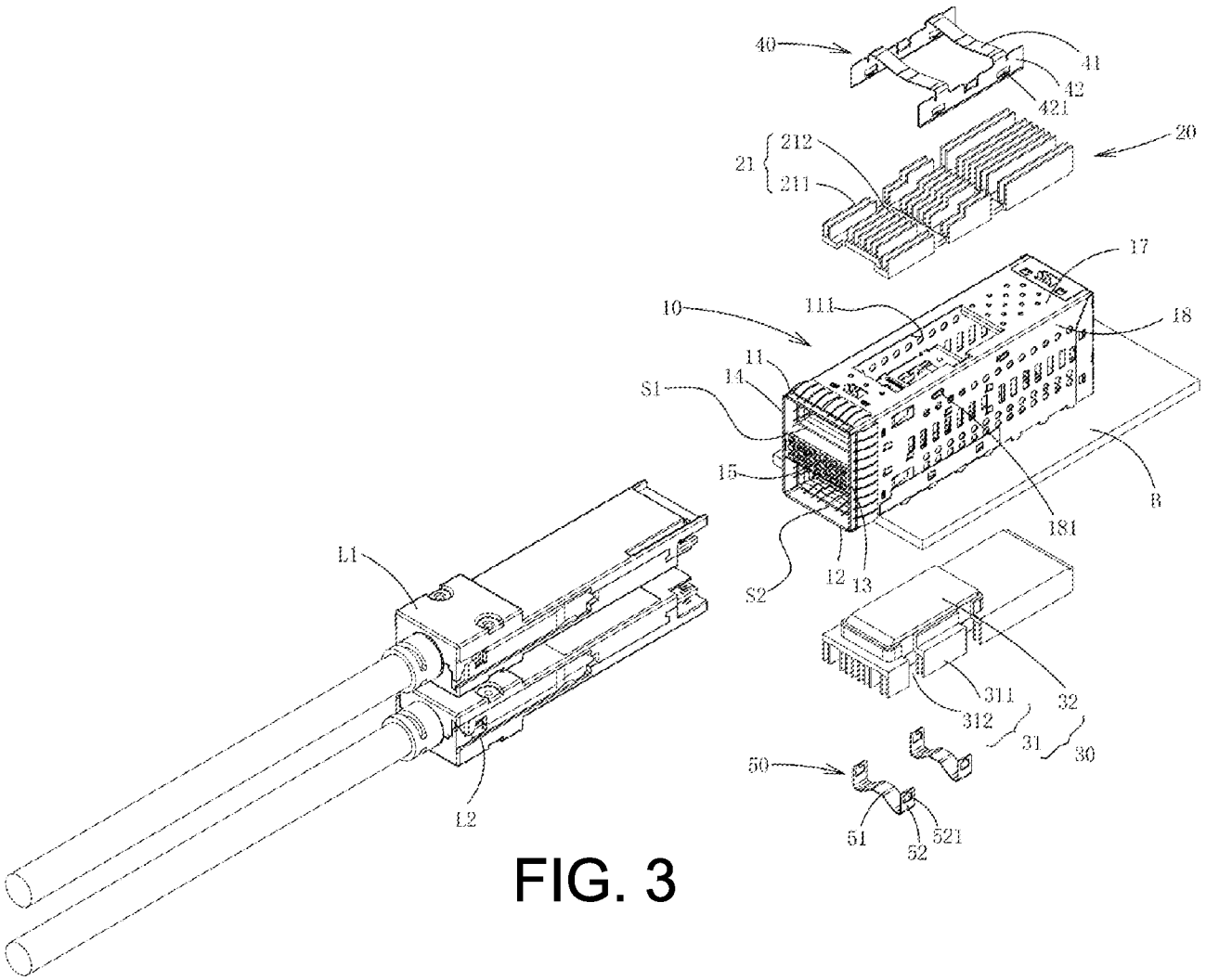
FIG. 3 is an exploded view of the interface connector of FIG. 1.
Figure 4:
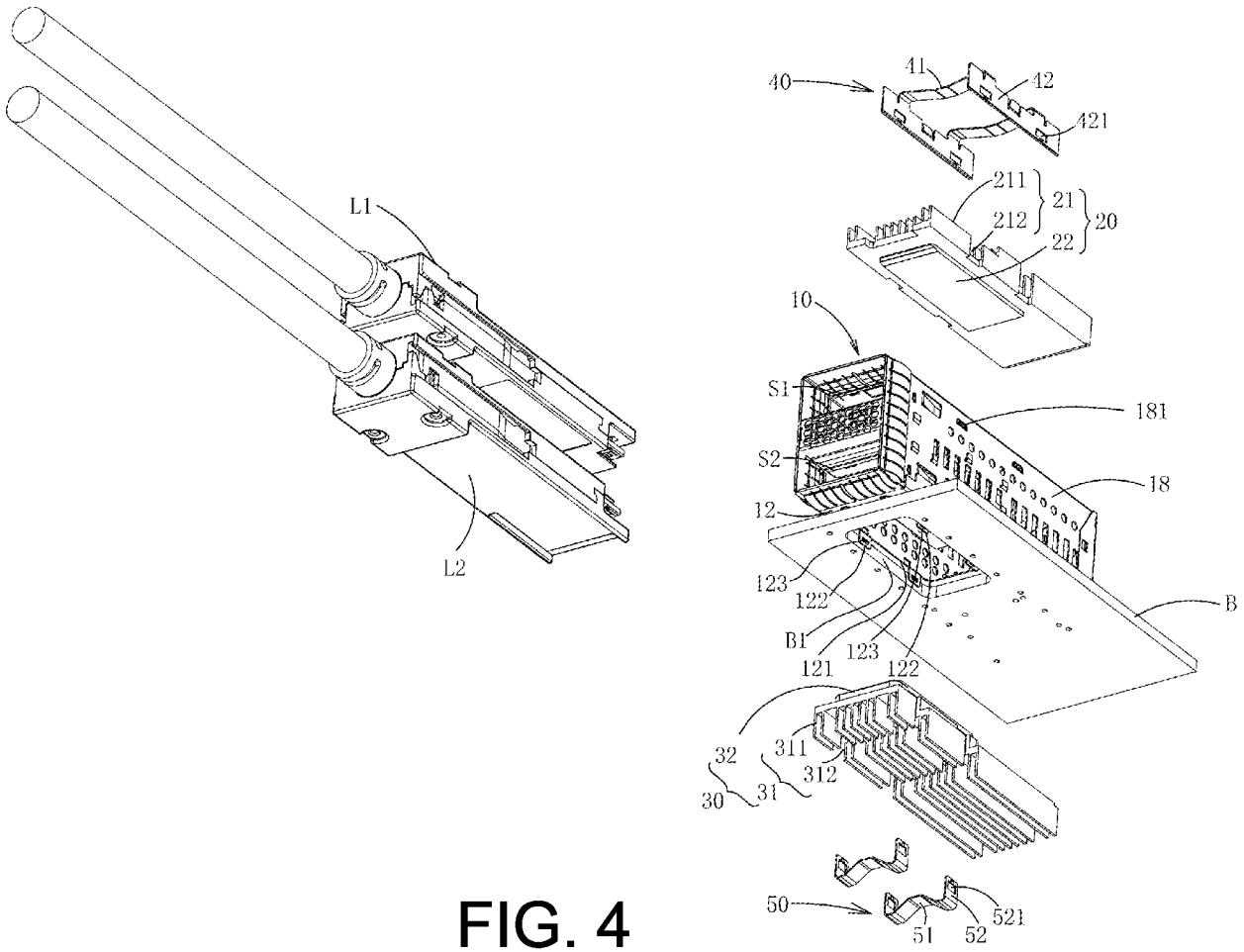
FIG. 4 is an exploded view in a different angle of the interface connector of FIG. 1.

FIG. 1 is a perspective view of connection between an interface connector with a mating connector of an embodiment of the present disclosure. FIG. 2 is a perspective view of the interface connector and the mating connector of FIG. 1 of the present disclosure. FIG. 3 is an exploded view of the interface connector of FIG. 1. FIG. 4 is an exploded view in a different angle of the interface connector of FIG. 1. As shown in the figures, in this embodiment, an interface connector 1 is provided, comprising a housing 10, a first heat dissipating member 20, and a second heat dissipating member 30. In this embodiment, the housing 10 comprises a top wall 11, a bottom wall 12, and two opposite sidewalls 13 and 14 connecting with the top wall 11 and the bottom wall 12. The bottom wall 12 of the housing 10 is disposed on the circuit board B.

As shown in FIG. 2 and FIG. 3, in this embodiment, the housing 10 further comprises a partitioning part 15 partitioning the inner space of the housing 10 to form a first accommodating space S1 and a second accommodating space S2. In this embodiment, the partitioning part 15 is a plate and is connected with the sidewalls 13 and 14. The partitioning part 15, the top wall 11, and the sidewalls 13 and 14 form the first accommodating space S1. The partitioning part 15, the bottom wall 12, and the sidewalls 13 and 14 form the second accommodating space S2. Since the bottom wall 12 is disposed on the circuit board B, the circuit board B corresponds to the second accommodating space S2.

As shown in FIG. 2, FIG. 3, and FIG. 4, the first heat dissipating member 20 is disposed at the outside of the housing 10 and extends into the first accommodating space S1 through the housing 10 to be connected with the first mating connector L1. The second heat dissipating member 30 is disposed on the circuit board B and extends into the second accommodating space S2 to be connected with the second mating connector L2. The first mating connector L and the second mating connector L2 could be, for example, an optical module.

Although the housing 10 of this embodiment comprises the first accommodating space S1 and the second accommodating space S2 to form a stack-type component, it is not limited to the present disclosure. In another embodiment, the housing does not have a partitioning part, so in the housing there is only one accommodating space in which one mating connector is disposed. The first heat dissipating member disposed on the top of the housing and the second heat dissipating member disposed on the circuit board respectively pass through the housing to be connected with the mating connector disposed in the accommodating space for heat dissipation.

Figure 5:
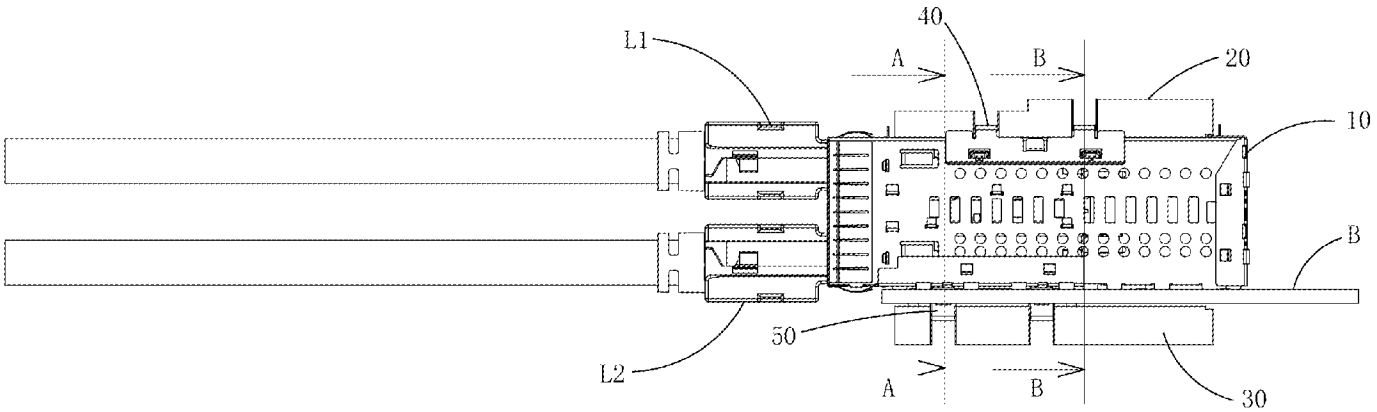
FIG. 5 is a side view of the connection of the interface connector with the mating connector of FIG. 1.
Figure 6:
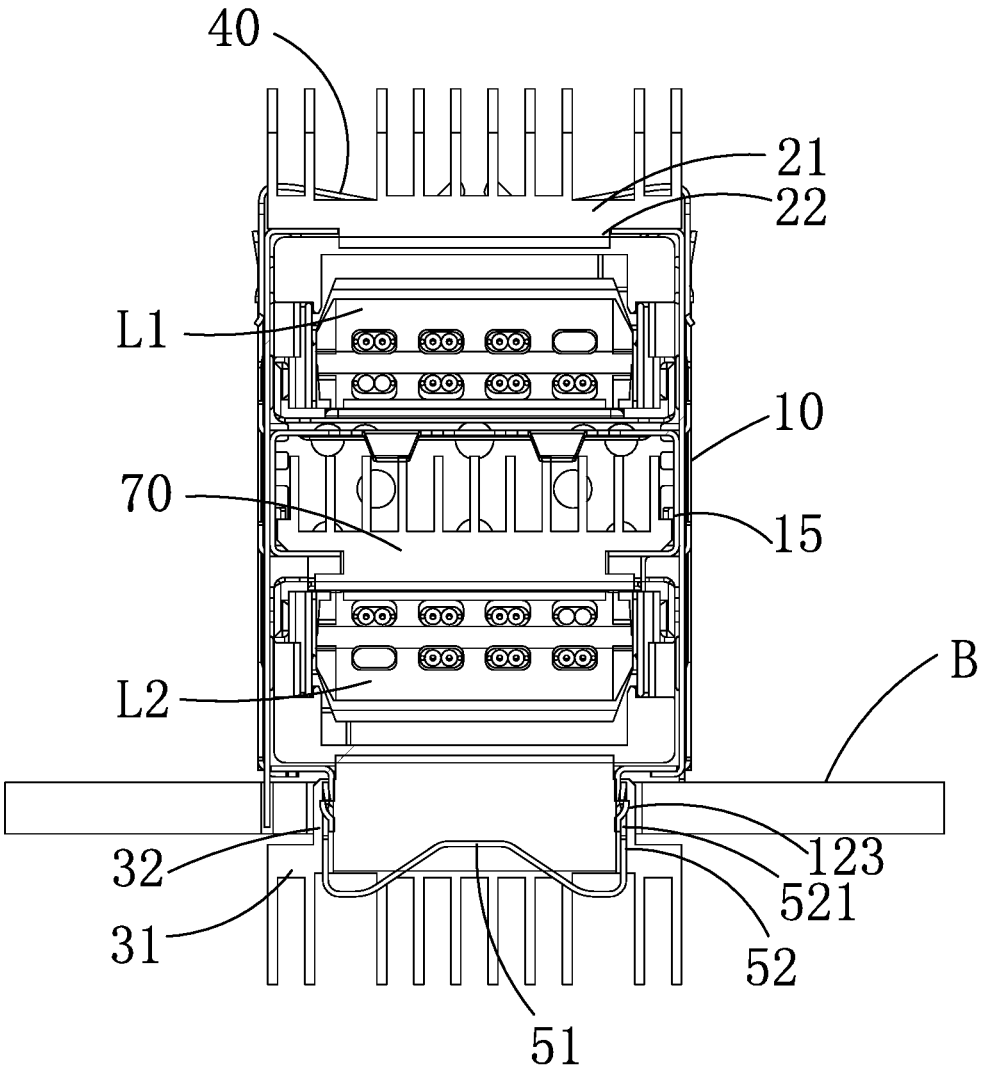
FIG. 6 is a cross-sectional view along line A-A of the connection of the interface connector with the mating connector of FIG. 5.
Figure 7:
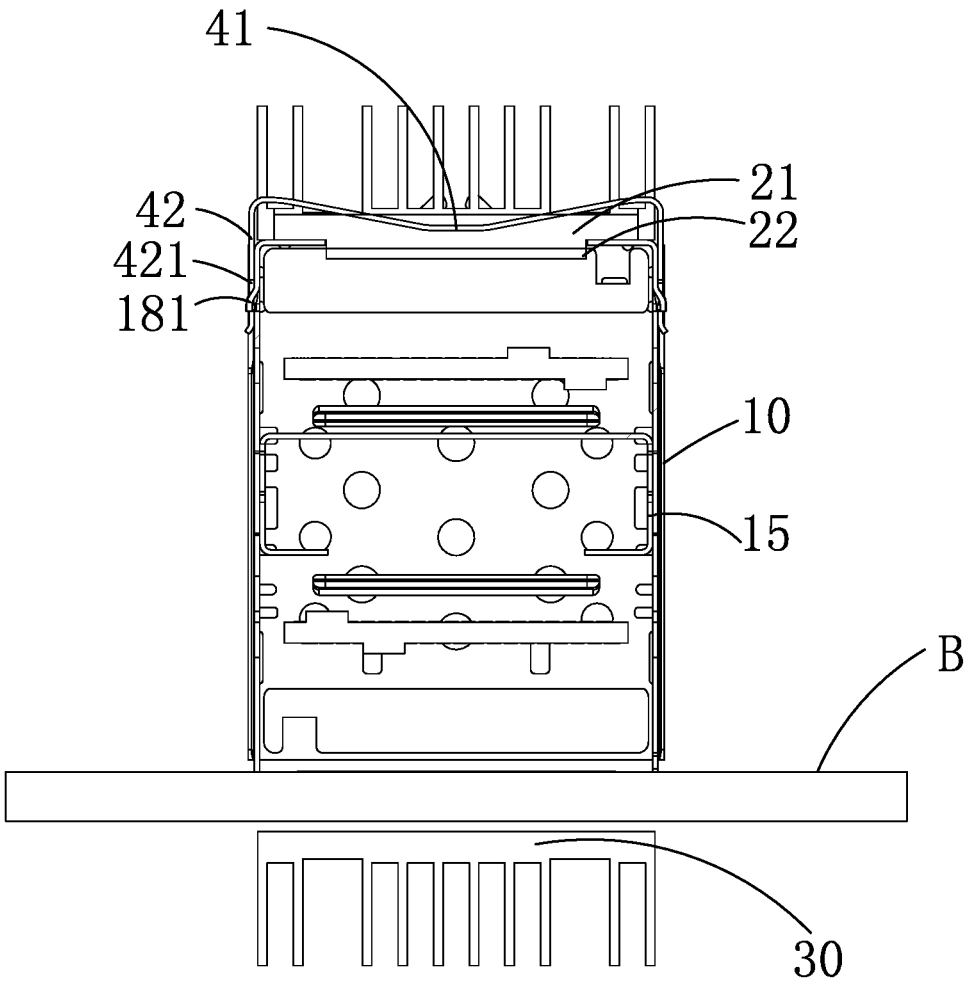
FIG. 7 is a cross-sectional view along line B-B of the connection of the interface connector with the mating connector of FIG. 5.

FIG. 5 is a side view of the connection of the interface connector with the mating connector of FIG. 1. FIG. 6 is a cross-sectional view along line A-A of the connection of the interface connector with the mating connector of FIG. 5. FIG. 7 is a cross-sectional view along line B-B of the connection of the interface connector with the mating connector of FIG. 5. Referring to FIG. 3. FIG. 6, and FIG. 7, the first heat dissipating member 20 comprises a first heat dissipating member body 21 and a first extending part 22. The first heat dissipating member body 21 is disposed on a first outer surface 17 of the top wall 11 of the housing 10. The first extending part 22 extends from the first heat dissipating member body 21 into the first accommodating space S1 through the top wall 11 of the housing 10. When the first mating connector L1 is inserted into the first accommodating space S1, the first extending part 22 would abut against the first mating connector L1. The first heat dissipating member body 21 comprises a plurality of fin-type first heat dissipating components 211. The first extending part 22 is a boss protruding from the bottom of the first heat dissipating member body 21. As shown in FIG. 3 and FIG. 6, a first opening 111 is disposed on the top wall 11 of the housing 10. When the first heat dissipating member body 21 is installed to the first outer surface 17 of the top wall 11 of the casing 10, the first extending part 22 would extend through the first opening 111 into the first accommodating space S1. When the first mating connector L1 is inserted into the first accommodating space S1, the first extending part 22 would abut against a top end of the first mating connector L1. The heat generated by the first mating connector L1 is conducted to the first heat dissipating member body 21 through the first extending part 22 by heat conducting, and is dissipated by the fin-type first heat dissipating component 211 of the first heat dissipating member body 21 along with external airflow by heat convection. In this embodiment, the first heat dissipating member 20 is made of materials with excellent heat conductivity, such as metallic copper.

As shown in FIG. 3, FIG. 4, and FIG. 7, in this embodiment, the interface connector 1 further comprises a first assembling member 40 abutting against the first heat dissipating member body 21 to allow the first heat dissipating member body 21 to abut against the first outer surface 17 of the housing 10. The first assembling member 40 comprises a first abutting part 41 and a first engaging part 42. The first engaging part 42 is connected with the first abutting part 41, and the first abutting part 41 abuts against the first heat dissipating member body 21. The first engaging part 42 is engaged with a second outer surface 18 of the housing 10. The second outer surface 18 is an outer surface of the sidewalls 13 and 14 and is adjacent to the first outer surface 17. The first assembling member 40 is U-shaped. The first abutting part 41 crosses the first heat dissipating member body 21. The first engaging part 42 is orthogonal to the first abutting part 41 and extends along the second outer surface 18. The first engaging part 42 comprises an engaging hole 421, and the second outer surface 18 of the housing 10 is provided with an engaging bump 181. By engaging the engaging bump 181 with the engaging hole 421, the first engaging part 42 can be engaged with the sidewalls 13 and 14 of the housing 10.

The first heat dissipating member body 21 comprises a first assembling groove 212. The first assembling groove 212 is disposed on the fin-type first heat dissipating component 211. The first abutting part 41 is disposed in the first assembling groove 212. When the first engaging part 42 is engaged with the second outer surface 18 of the sidewalls 13 and 14 of the housing 10, the first abutting part 41 would abut against a surface of the first heat dissipating member body 21 forming the bottom of the first assembling groove 212, allowing the first heat dissipating member body 21 to abut against the first outer surface 17 of the top wall 11 of the housing 10, and also allowing the first extending part 22 of the first heat dissipating member 20 to firmly press the first mating connector L1 downward. In this way, the thermal resistance of heat conduction can be reduced, the heat flow of heat conduction can be increased, and the heat dissipation of the first mating connector L1 can be improved.

As shown in FIG. 3, FIG. 4, FIG. 6, and FIG. 7, the second heat dissipating member 30 comprises a second heat dissipating member body 31 and a second extending part 32. The second extending part 32 extends from the second heat dissipating member body 31 into the second accommodating space S2 through the circuit board B and the bottom wall 12 of the housing 10 and abuts against the second mating connector L2 inserted in the second accommodating space S2. As shown in FIG. 3, the second extending part 32 is a boss protruding from the bottom surface of the second heat dissipating member body 31. The bottom wall 12 of the housing 10 comprises a second opening 121, and the circuit board B comprises a third opening B1. The third opening B1 corresponds to the second opening 121. The second extending part 32 extends through the second opening 121 and the third opening B1 into the second accommodating space S2. The heat generated by the second mating connector L2 is conducted to the second heat dissipating member body 31 through the second extending part 32 by heat conducting, and is dissipated by the fin-type heat dissipating component of the second heat dissipating member body 31 along with external air flow by heat convection.

As shown in FIG. 3, FIG. 4, and FIG. 6, in this embodiment, the interface connector 1 further comprises a second assembling member 50 abutting against the second heat dissipating member body 31 to allow the second heat dissipating member body 31 to abut against the circuit board B. The second assembling member 50 comprises a second abutting part 51 and a second engaging part 52 connected with the second abutting part 51. The second abutting part 51 abuts against the second heat dissipating member body 31. The second engaging part 52 passes through the third opening B1 to engage with an edge of the second opening 121 of the housing 10. The second assembling member 50 is U-shaped. The second abutting part 51 crosses the second heat dissipating member body 31, and the second engaging part 52 extends from the second abutting part 51 into the third opening B1. As shown in FIG. 4 and FIG. 6, a plurality of extending engaging parts 122 extending into the third opening B1 of the circuit board B are disposed on the edge of the second opening 121 of the housing 10. An engagement bump 123 is disposed at the extending engaging parts 122. An engaging hole 521 is disposed at the second engaging part 52. By engaging the engaging hole 521 with the engaging bump 123, the second assembling member 50 can be engaged with the housing 10. The second heat dissipating member body 31 comprises a fin-type second heat dissipating component 311 and a second assembling groove 312 disposed in the second heat dissipating component 311. The second abutting part 51 is disposed in the second assembling groove 312 and abuts against a surface of the second heat dissipating member body 31 forming the bottom surface of the second assembling groove 312. In this way, the second heat dissipating member body 31 could abut against the circuit board B, and the second extending part 32 of the second heat dissipating member 30 can be pressed downward to press against the second mating connector L2 to reduce the thermal resistance of heat conduction, to increase the heat flow of heat conduction, and to improve heat dissipation of the second mating connector L2.

As shown in FIG. 6, the interface connector 1 of this embodiment further comprises a third heat dissipating member 70. The third heat dissipating member 70 is disposed at the partitioning part 15 and extends into the second accommodating space S2 to abut against the second mating connector L2. The heat generated by the second mating connector L2 is conducted to the third heat dissipating member 70 by heat conduction and is dissipated by the fin-type heat dissipating component of the third heat dissipating member 70 along with external airflow flowing into the housing 10 by heat convection.

In this embodiment, a first heat dissipating member is disposed at a position at the outside the housing corresponding to the first accommodating space and passes through the housing to be connected with the first mating connector. A second heat dissipating member is disposed at a position on the circuit board corresponding to the second accommodating space and passes through the circuit board and the housing to be connected with the second mating connector. The heat generated by the first mating connector can be conducted to the first heat dissipating member by heat conduction and is dissipated to the air by the first heat dissipating member, and the heat generated by the second mating connector stacked with the first mating connector is conducted to the second heat dissipating member by heat conduction and is dissipated to the air by the second heat dissipating member. By respectively disposing the first heat dissipating member and the second heat dissipating member at positions at the outside of the housing corresponding to the first accommodating space and to the second accommodating space, heat emitted by the first mating connector and the second mating connector can be effectively dissipated through the components connecting with the first heat dissipating member and the second heat dissipating member. Thus, the heat dissipation issue of mating connectors equipped with high power chips can be well handled.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An interface connector disposed at a circuit board, comprising:

a housing, a first accommodating space disposed in the housing, the first accommodating space accommodating a first mating connector, one side of the housing being disposed at the circuit board;

a first heat dissipating member disposed at the outside of the housing, the first heat dissipating member passing through the housing and extending into the first accommodating space to being connected to the first mating connector;

a second heat dissipating member disposed at the circuit board, the second heat dissipating member passing through the circuit board and the housing and extending into the housing; and a second assembling member abutting against the second heat dissipating member, so that the second heat dissipating member being positioned on the circuit board.

2. The interface connector according to claim 1, wherein the first heat dissipating member comprises a first heat dissipating member body and a first extending part; the first heat dissipating member body is disposed on an outer surface of the housing; the first extending part extends from the first heat dissipating member body into the first accommodating space through the housing; the first extending part abuts against the first mating connector inserted in the first accommodating space.

3. The interface connector according to claim 2 comprising a first assembling member abutting against the first heat dissipating member, allowing the first heat dissipating member body to abutting against a first outer surface of the housing.

4. The interface connector according to claim 3, wherein the first assembling member comprises a first abutting part and a first engaging part connected with the first abutting part; the first abutting part abuts against the first heat dissipating member body; the first engaging part is engaged with a second outer surface of the housing; the second outer surface is adjacent to the first outer surface.

5. The interface connector according to claim 4, wherein the first heat dissipating member body comprises a fin-type first heat dissipating component and a first assembling groove disposed in the first heat dissipating component; the first abutting part is disposed in the first assembling groove.

6. The interface connector according to claim 1, wherein the second heat dissipating member comprises a second heat dissipating member body and a second extending part; the second extending part extends from the second heat dissipating member body into the housing through the circuit board and the housing.

7. The interface connector according to claim 6, wherein the second assembling member comprises a second abutting part and a second engaging part connected with the second abutting part; the second abutting part abuts against the second heat dissipating member body; the second engaging part passes through a third opening of the circuit board and engages with an edge of the second opening of the housing.

8. The interface connector according to claim 7, wherein the second heat dissipating member body comprises a fin-type second heat dissipating component and a second assembling groove disposed in the second heat dissipating component; the second abutting part is disposed in the second assembling groove.

9. The interface connector according to claim 1, the housing comprises a partitioning part partitioning an inner space of the housing to form a first accommodating space and a second accommodating space; the second accommodating space accommodates a second mating connector; the second heat dissipating member extends into the second accommodating space and is connected with the second mating connector.

10. The interface connector according to claim 9 comprising a third heat dissipating member, the third heat dissipating member being disposed at the partitioning part and extending into the second accommodating space to abutting against the second mating connector.

* * * * *